US005868156A

United States Patent [19]

Korthaus

[11] Patent Number: 5,868,156

[45] Date of Patent: Feb. 9, 1999

[54] CONCRETE DISTRIBUTION SYSTEM FOR TRANSPORTABLE CONCRETE

[76] Inventor: Ernst Korthaus, Gebringer Schlade 7, 58802 Balve, Germany

[21] Appl. No.: 942,394

[22] Filed: Oct. 10, 1997

[51] Int. Cl.[6] ..... F16K 3/36

[52] U.S. Cl. ..... 137/240; 137/615

[58] Field of Search ..... 137/615, 240

[56] References Cited

U.S. PATENT DOCUMENTS

| | | | |
|---|---|---|---|
| 3,789,869 | 2/1974 | Morris | 137/615 |
| 3,893,480 | 7/1975 | Dunbar | 137/615 |
| 4,130,134 | 12/1978 | Castle | 137/615 |
| 4,391,297 | 7/1983 | Knight | 137/615 |
| 4,526,090 | 7/1985 | Maier | 137/615 |
| 5,323,800 | 6/1994 | Vollweiler et al. | 137/240 |

*Primary Examiner*—A. Michael Chambers
*Attorney, Agent, or Firm*—Walter Ottesen

[57] ABSTRACT

The invention is directed to a concrete distribution system for transportable concrete and includes a concrete conveying pipe line of several pipe sections and a pipe line carrier boom of several carrier boom segments. The concrete distribution system is so configured that it can be conveniently used in spatially limited construction sites such as tunnels. This is achieved in that pipe sections (6, 8) are connected to corresponding ones of the carrier boom segments (4, 5). The pipe sections are telescopically engaged with each other and the boom; segments are likewise telescopically engaged with each other. The pipe sections and boom segments are extended and retracted in tandem.

9 Claims, 2 Drawing Sheets

CONCRETE DISTRIBUTION SYSTEM FOR TRANSPORTABLE CONCRETE

FIELD OF THE INVENTION

The invention relates to a concrete distribution system for transportable concrete. The concrete distribution system includes a concrete conveyor pipe line of several pipe sections and a pipe guide carrier boom of several boom segments. The concrete conveyor pipe line is connected to a stationary or to a mobile concrete pump to which concrete is supplied. As a rule, this is transportable concrete.

BACKGROUND OF THE INVENTION

For a concrete distribution system of the above kind, it is necessary to configure the same so that its use is possible even at construction sites where free working space in elevation is limited, for example, in a tunnel or the like.

Concrete distribution systems for transportable concrete are known wherein the concrete conveyor pipe line comprises several pipe sections which are mounted so as to be foldable on the foldable pipe line carrier boom so that both are folded in the manner of a folding measuring scale. Here, the pipe line is guided through the knee joints of the carrier boom with a two-time 90° bend at each knee joint. These bends cause unwanted repulsions in the pumping operation and therefore cause increased loading of the structure of the carrier boom. Furthermore, to move the concrete conveyor pipe line into an operating position for a concrete distribution system of this type, a free working space with a minimum height corresponding to the length of a pipe section is required. The use of the known concrete distribution system is restricted because a corresponding free working space is often not available.

SUMMARY OF THE INVENTION

It is an object of the invention to expand the use possibilities of a concrete distribution system for transportable concrete and to avoid increased loading to the structure of the carrier boom.

The concrete distribution system of the invention includes:

a concrete conveyor pipe line including a plurality of telescopically engaging pipe sections; a pipe line carrier boom including a plurality of telescopically engaging boom segments corresponding to respective ones of the pipe sections; and, connecting means for connecting the pipe sections to corresponding ones of the boom segments to facilitate extending and retracting the concrete conveyor pipe line and the pipe line carrier boom in tandem.

The configuration of the concrete distribution system of the invention in combination with a concrete pump affords the advantage that the system can be used at construction sites where limited free working space in elevation is available such as in tunnels, factory buildings and the like.

The telescopic concrete conveyor line affords the further advantage that it is linear and repulsions because of sharp bends in the concrete conveyor line cannot occur, The structural configuration of the individual pipe sections with each pipe section having a piston and/or sealing head has proven especially advantageous in operation because hardened concrete residue cannot occur or can, under unfavorable conditions, be easily removed. The service life of the pistons and the seals is considerably increased thereby.

The concrete distribution system according to the invention can be combined with conventional knee joints and the concrete conveyor pipe lines associated therewith.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
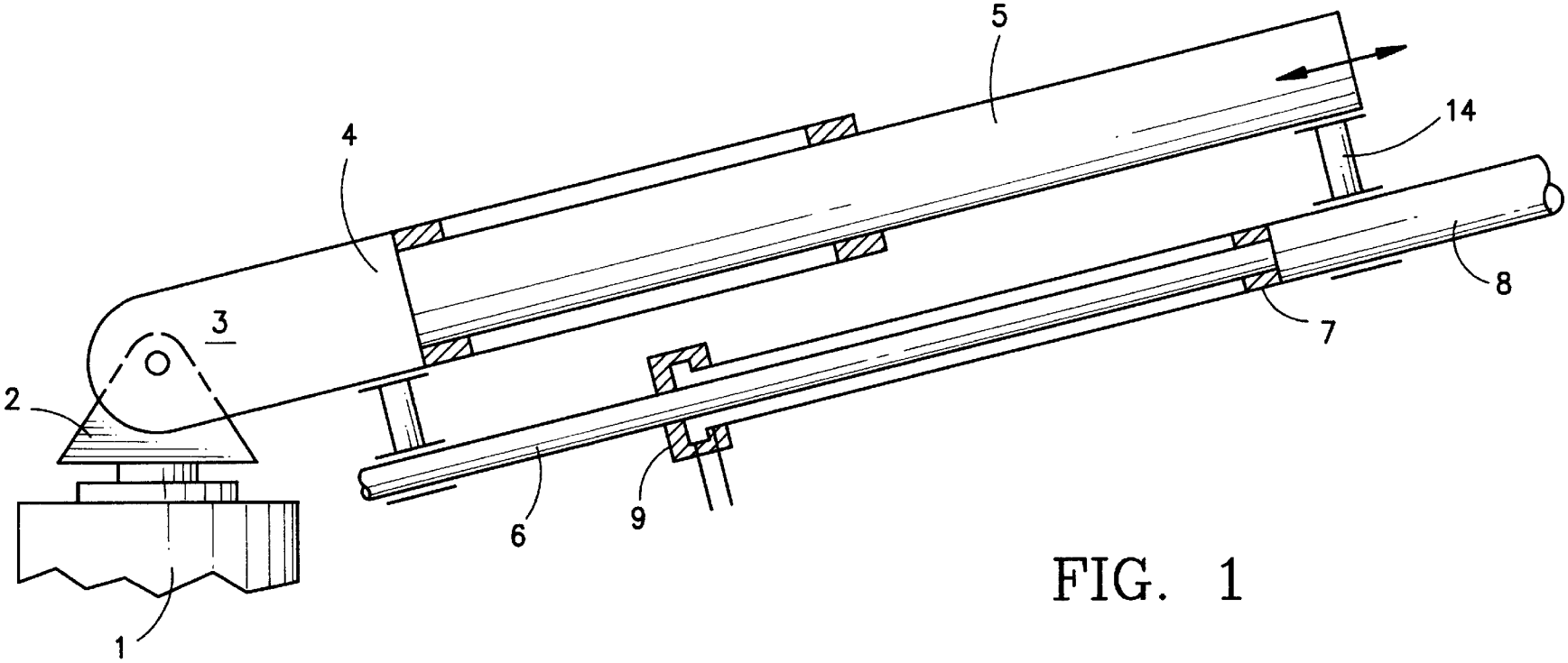
FIG. 1 is a schematic side elevation view of the concrete distribution system of the invention showing two pipe sections and two carrier boom segments; and, FIG. 2 schematically shows the telescopic concrete conveying pipe line in longitudinal section with piston and sealing head.

In FIG. 1, a turret 2 for the pipe line carrier boom 3 having carrier mast segments (4, 5) is attached to a carrier vehicle 1 which can be a truck or trailer. The truck or trailer, as a rule, also accommodates the concrete feed pump. The boom segment 5 can be telescopically driven in and out relative to boom segment 4. The pipe section 6 of the concrete conveyor pipe line is attached to the lower end of the carrier boom segment 4 and is connected to the concrete feed pump via the turret 2. This pipe section 6 has a piston 7 at one end thereof and this piston slides within the pipe section 8 when the pipe line and carrier boom are extended and retracted. The pipe section 8 surrounds the pipe section 6 and is attached at a location 14 to the carrier boom segment 5 and can slide via the sealing head 9 on the pipe section 6.

Figure 2:
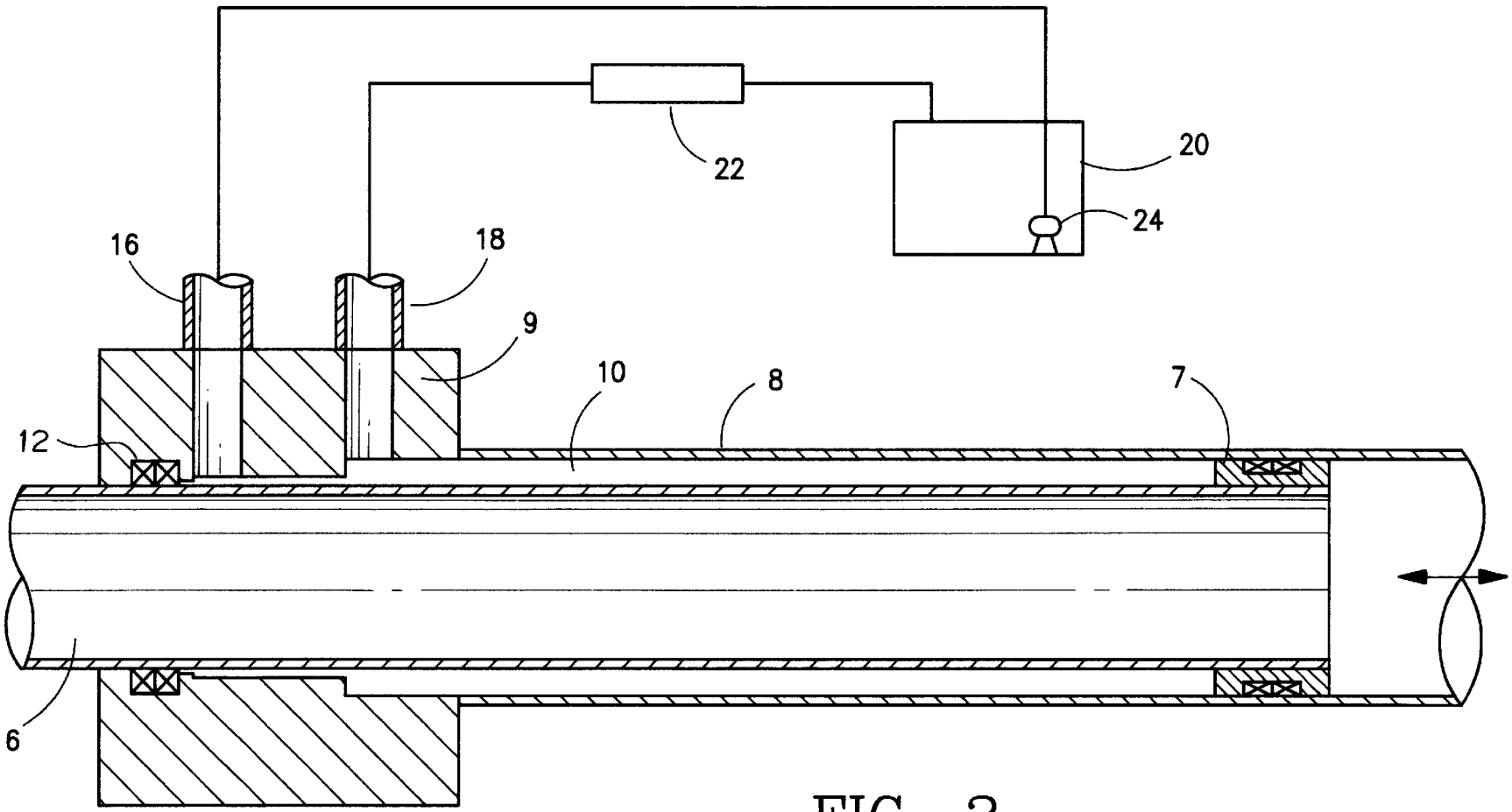

In FIG. 2, the piston 7 at the end of pipe section 6 is configured as a rubber piston and is rigidly attached. An annular flushing space remains between pipe section 6 and pipe section 8. The flushing space 10 can have different lengths depending upon the operating state of the concrete conveying pipe line.

The sealing head 9 is mounted at the lower end (the end closest to the turret 2) of the pipe section 8. The sealing head 9 seals pipe section 8 with respect to the first pipe section 6 and defines input and discharge connections (16, 18) for the flushing space 10. The seal configuration 12 can be provided with known sealing elements in a conventional manner. The sealing head 9 is advantageously provided with two connections (16, 18) for the inflow and outflow of a flushing agent.

The flushing agent is, as a rule, water with special additives or without such additives. The water is supplied from a water tank 20 and flows back to the tank.

Before the water flows back into the tank, it passes through a filter 22 having a sand filling for trapping the cement particles from the annular flushing space 10. In this way, the circulation pump 24 which circulates the water is protected against wear. Preferably, the pump 24 is mounted in the tank 20.

It is understood that the foregoing description is that of the preferred embodiments of the invention and that various changes and modifications may be made thereto without departing from the spirit and scope of the invention as defined in the appended claims.

What is claimed is:

1. A concrete distribution system comprising:

a concrete conveyor pipe line including a plurality of telescopically engaging pipe sections;

connecting means for connecting said pipe sections to corresponding ones of said boom segments to facilitate extending and retracting said concrete conveyor pipe line and said pipe line carrier boom in tandem;

each one of said pipe sections having first and second ends and each one of said pipe sections having a piston at the second end thereof for slidably engaging the next adjacent pipe section into which said one pipe section telescopically engages;

each one of said next adjacent pipe sections having a sealing head at the first end thereof for slidably engaging the pipe section telescopically received therein;

each one of the sealing heads, each one of said pistons and each two telescopically engaging pipe sections corresponding thereto conjointly defining a flushing space in which unwanted cement particles can accumulate during operation of said system; and, flushing means for passing a flushing agent through said flushing space to entrain and remove said cement particles therefrom.

2. The concrete distribution system of claim 1, said piston being made of elastic sealing material and being rigidly connected to the pipe section; said sealing head including a seal for sealably engaging the pipe section telescopically received in the pipe section corresponding to said sealing head; and, said flushing means including connecting stubs communicating with said flushing space.

3. The concrete distribution system of claim 2, said piston having a seal made of rubber for sealably engaging the inner wall of the next adjacent pipe section.

4. The concrete distribution system of claim 2, further comprising a tank for holding a flushing agent and said tank being connected to said connecting stubs.

5. The concrete distribution system of claim 4, further comprising a pump for pumping said flushing agent into and from said flushing space.

6. The concrete distribution system of claim 1, said flushing space being an enclosed annular space.

7. A concrete distribution system comprising:

a concrete conveyor pipe line including a plurality of telescopically engaging pipe sections;

a pipe line carrier boom including a plurality of telescopically engaging boom segments corresponding to respective ones of said pipe sections;

connecting means for connecting said pipe sections to corresponding ones of said boom segments to facilitate extending and retracting said concrete conveyor pipe line and said pipe line carrier boom in tandem;

each one of said pipe sections having first and second ends and each one of said pipe sections having a piston at the second end thereof for slidably engaging the next adjacent pipe section into which said one pipe section telescopically engages;

each one of said next adjacent pipe sections having a sealing head at the first end thereof for slidably engaging the pipe section telescopically received therein;

each one of the sealing heads, each one of said pistons and each two telescopically engaging pipe sections corresponding thereto conjointly defining an enclosed flushing space in which unwanted cement particles can accumulate during operation of said system;

inlet and outlet connecting stubs communicating with said enclosed flushing space;

a tank for holding a flushing agent and said tank being connected to said connecting stubs; and, a pump for pumping said flushing agent from said tank into and through said enclosed flushing space via said inlet connecting stub and from said enclosed flushing space via said outlet connecting stub whereby said flushing agent entrains and removes said cement particles away from said enclosed flushing space.

8. The concrete distribution system of claim 7, further comprising a filter interposed between said enclosed flushing space and said tank for trapping said cement particles thereby protecting said pump against wear.

9. The concrete distribution system of claim 8, wherein said pump is mounted in said tank.

* * * * *

UNITED STATES PATENT AND TRADEMARK OFFICE

CERTIFICATE OF CORRECTION

PATENT NO. : 5,868,156
DATED : February 9, 1999
INVENTOR(S) : Ernst Korthaus

It is certified that error appears in the above-identified patent and that said Letters Patent is hereby corrected as shown below:

On the title page, between [22] and[51], insert:
-- [30] October 10, 1996 [DE] Germany … 196 41 789.9 --.

In column 2, between lines 61 and 62, insert: -- a pipe line carrier boom including a plurality of telescopically engaging boom segments corresponding to respective ones of said pipe sections; and, --.

Signed and Sealed this

Third Day of August, 1999

*Attest:*

Q. TODD DICKINSON

*Attesting Officer*

*Acting Commissioner of Patents and Trademarks*